US007398858B2

(12) United States Patent
Bicker et al.

(10) Patent No.: US 7,398,858 B2
(45) Date of Patent: Jul. 15, 2008

(54) OIL PAN ARRANGEMENT

(75) Inventors: Wolf-Dietrich Bicker, Trebur (DE); Peter Eichert, Kaiserslautern (DE); Torsten Löhnert, Liederbach (DE)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/569,195

(22) PCT Filed: May 18, 2005

(86) PCT No.: PCT/EP2005/005416

§ 371 (c)(1),
(2), (4) Date: Nov. 16, 2006

(87) PCT Pub. No.: WO2005/113948

PCT Pub. Date: Dec. 1, 2005

(65) Prior Publication Data

US 2007/0221447 A1 Sep. 27, 2007

(30) Foreign Application Priority Data

May 18, 2004 (DE) ..... 10 2004 024 517

(51) Int. Cl.

| | |
|---|---|
| ***F16N 31/00*** | (2006.01) |
| ***F16N 31/02*** | (2006.01) |
| ***F02F 7/00*** | (2006.01) |
| ***F01M 11/02*** | (2006.01) |

(52) U.S. Cl. ..... 184/106; 123/195 C; 123/196 R; 123/198 E

(58) Field of Classification Search ..... 123/195 C, 123/198 E, 196 R, 196 CP, 495, 509; 184/106, 184/6.5; 220/563
See application file for complete search history.

(56) References Cited

U.S. PATENT DOCUMENTS

| | | | | |
|---|---|---|---|---|
| 4,179,036 | A * | 12/1979 | Pasini | 220/563 |
| 4,479,463 | A | 10/1984 | Curley et al. | |
| 4,930,469 | A * | 6/1990 | Kamprath et al. | 123/195 C |
| 5,884,600 | A * | 3/1999 | Wang et al. | 123/193.6 |
| 6,041,752 | A * | 3/2000 | Van Klompenburg | 123/195 C |
| 6,058,898 | A * | 5/2000 | Freese, V | 123/195 C |
| 6,131,543 | A * | 10/2000 | Achenbach et al. | 123/195 C |
| 6,555,241 | B1 * | 4/2003 | Erbsloh et al. | 428/472 |
| 6,715,459 | B2 * | 4/2004 | Rosendahl et al. | 123/195 C |
| 6,802,121 | B2 * | 10/2004 | Fuganti et al. | 29/888.061 |

FOREIGN PATENT DOCUMENTS

| | | |
|---|---|---|
| DE | 3812400 | 10/1989 |
| DE | 4011759 | 10/1990 |
| DE | 4010946 | 10/1991 |

(Continued)

*Primary Examiner*—Stephen K. Cronin
*Assistant Examiner*—Ka Chun Leung
(74) *Attorney, Agent, or Firm*—Ingrassia Fisher & Lorenz, P.C.

(57) ABSTRACT

The invention relates to an oil pan arrangement for an internal-combustion engine including a cover part, a bottom part for the oil pan and at least one suction pipe which opens out into an suction region of the bottom part. The suction pipe is connected to the suction region and the bottom part in one piece manner. The suction region comprises a wall portion which incorporates at least one suction window.

15 Claims, 4 Drawing Sheets

FOREIGN PATENT DOCUMENTS

| | | | | |
|---|---|---|---|---|
| DE | 10026113 | | | 11/2001 |
| GB | 2305467 | | | 4/1997 |
| JP | 09-166060 | A | * | 6/1997 |
| JP | 10-002210 | A | * | 1/1998 |
| JP | 2004-2934910 | A | * | 10/2004 |

* cited by examiner

OIL PAN ARRANGEMENT

CROSS-REFERENCE TO RELATED APPLICATIONS

This application is a U.S. National-Stage entry under 35 U.S.C. § 371 based on International Application No. PCT/EP2005/005416, filed May 18, 2005, which was published under PCT Article 21(2) and which claims priority to German Application No. DE 10 2004 024 517.7, filed May 18, 2004.

FIELD OF THE INVENTION

The invention relates to an oil pan arrangement for an internal-combustion engine including a cover part, a bottom part for the oil pan and at least one suction pipe which opens out into an suction region of the bottom part, wherein the suction pipe is connected to the suction region and the bottom part in a one piece manner.

BACKGROUND

An oil pan for an internal-combustion engine including a flat bottom part and also a deep pan section for the oil pan and a suction pipe for an oil pump which opens out into the deep pan section is described in DE 40 10 946 A1, wherein the deep pan section is in the form of a removable oil container. The suction pipe, which is fixed to the oil pan by means of bolted connections, is bell-shaped at the lower end thereof and is provided with a filter which is slightly spaced from the base of the oil container when the oil container is mounted in position.

An internal-combustion engine that is described in DE 3,812,400 is provided with an oil pan in which the oil flowing back from the coolant and lubricant circulating systems of the internal-combustion engine is collected. Here, a suction pipe running from an oil pump of the internal-combustion engine into the oil pan of the internal-combustion engine via a suction funnel ends shortly above the base of the oil pan in the centre of the oil pan. One of the disadvantages of these known devices is the high assembly cost due to the multiplicity of individual components. The suction pipe for example must be fixed at various points (e.g. by bolted connections) and it must also be sealed so as to prevent leakage. As a result thereof, there is a large number of assembly steps which has a negative effect upon the costs of the oil pan arrangement. Moreover, the flow properties of the oil that is to be sucked-in in the suction region of the suction pipe are not satisfactory in the known oil pan assemblies.

An internal-combustion engine having an oil deflecting part arranged between the crank case and the oil pan is known from DE 100 26 113 A1. The oil deflecting part is provided with oil channels that extend those oil channels, which run in the cylinder crankcase and lead to an aperture, up to the oil reservoir of the oil pan. These oil channels can be oil pressure delivery channels or else oil suction channels. Hereby, the oil deflecting part together with its channels can be manufactured as a complete entity. Here too, there is a resultant disadvantage that the flow properties of the oil that is to be sucked-in in the inlet region of the suction pipe are not satisfactory.

Reference is also made to DE 40 11 759 A1 for a general technical understanding.

SUMMARY

The present invention provides an oil pan arrangement wherein the disadvantages mentioned above are avoided, and in particular an oil sump assembly is produced which is of low weight and exhibits better flow properties for the oil that is to be sucked-in as well as having low assembly costs.

In accordance with the invention, provision is made for the suction pipe to be connected to the inlet region and the bottom part in one piece manner. A compact construction is obtained by the one piece design of the oil sump assembly which at the same time represents savings in terms of weight and cost. Incorrect assembly by the worker in regard to the suction pipe whereby possible leakages could occur, is prevented insofar as possible by the arrangement in accordance with the invention. The bottom part can, for example, be a pressure die cast part made of metal or an injection moulded part of synthetic material.

In one embodiment of the oil sump assembly in accordance with the invention, the inlet region comprises a wall portion which incorporates at least one inlet window. An oil pump, which may be a gear pump, a crescent pump or a rotor pump for example, ensures that there is a negative pressure at the inlet end of the suction pipe (in the inlet region), whereby the oil (oil reservoir) located in the bottom part flows through the inlet window into the inlet region and thus into the suction pipe. Self-evidently, it is also possible to provide the wall portion with a plurality of inlet windows. The sucked-in oil flows through the suction pipe, through the oil pump and reaches, in particular, the individual engine lubrication points such as e.g. the ball shaft bearing, the connecting rod bearing, the tappets, the cam shaft bearing etc. It is important hereby that these individual points be supplied with a sufficient quantity of oil, in particular, in order to obtain the requisite lubricating, cooling and engine noise absorption effect.

Preferably, the inlet region comprises a cover unit so that the oil that is to be sucked-in can flow only through the inlet windows into the inlet region and thus into the suction pipe. By virtue of the cover unit in particular, the effect is achieved that air will not be sucked in and conveyed together with the oil due to the negative pressure effective within the inlet region as this would have a disadvantageous effect upon the lubrication of the engine. Hereby, the cover unit rests directly upon the wall portion of the inlet region so that only the oil can flow through the inlet windows into the suction pipe. A kind of vortex effect with simultaneous enrichment of the oil with air is thus effectively prevented within the inlet region.

In one alternative embodiment, the wall portion can be of a substantially cylindrical shape. In another alternative, a parallelepiped design of the wall portion is likewise possible, whereby further geometrical designs are naturally also conceivable.

The wall portion expediently incorporates a first and a second wall section which are separated or spaced by a first and a second inlet window. Hereby, the first wall section can be connected to the suction pipe in one piece manner. The cover unit is preferably connected to the wall portion in positive and/or non-positive manner, this meaning that the cover unit rests upon the wall portion in such a manner that the oil cannot penetrate between the cover unit and the wall portion.

Preferably, the inlet region comprises guidance means for guiding the oil into the suction channel. Hereby for example, the guidance means can be arranged on the cover unit. In an alternative form of the invention, the guidance means are in the form of guide channels which convey the oil flow from the respective inlet window to the suction channel. The guidance means are effective to improve the process of sucking-in the oil, whereby pressure losses developing at the same time can be kept small.

In a further embodiment of the invention, the cover unit at least partially closes the inlet window or windows. It is conceivable for the inlet window to have different sized openings in dependence on the particular lubrication requirements of the engine.

Preferably, the cover unit is connected to the cover part in one piece manner. During the process of mounting the oil sump assembly, the cover part can be fixed to the bottom part by means of bolted connections for example, whereby the cover unit is simultaneously positioned in the inlet region without the need for additional assembly steps. Self-evidently, it is also conceivable for the cover unit to be in the form of a separate component. It is expedient for the cover unit and/or the cover part to be in the form of an injection moulded part made of synthetic material. It is likewise possible for the cover unit and the cover part to be made of metal.

Preferably, the cover part comprises openings through which the oil flows into the bottom part. The oil dripping back from the engine lubrication system initially encounters the cover part and from there, it enters the bottom part via various openings. The particular intention here is for the oil to initially settle down prior to being fed through the suction channel to the engine lubrication system.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
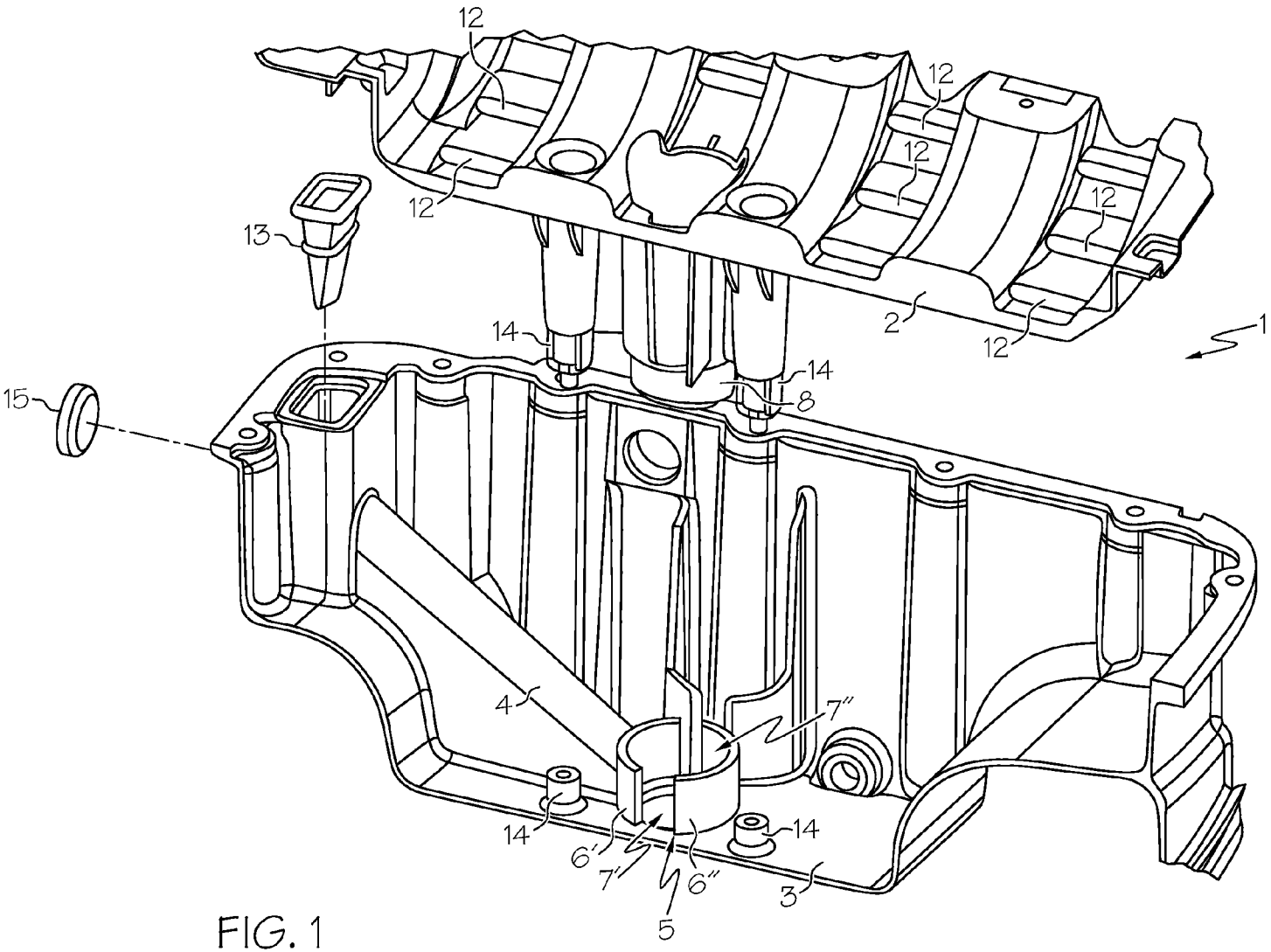
FIG. 1 shows the oil pan arrangement in accordance with the invention comprising a cover part and a bottom part in the form of an exploded illustration.

FIG. 1 shows an oil pan arrangement 1 in accordance with the invention for an internal-combustion engine comprising a cover part 2 and a bottom part 3. The bottom part 3 is provided with a suction pipe 4 which opens out at one end in an suction region 5 of the bottom part 3. The oil that is used for lubricating the engine is located in the bottom part 3 of the oil pan arrangement 1. It is particularly advantageous for the suction pipe 4 to be connected to the suction region 5 and the bottom part 3 in one piece manner. The suction region 5 comprises a first 6' and a second wall section 6", whereby both wall sections 6', 6" are spaced apart by a first 7' and a second suction window 7". As FIG. 1 clearly shows, the wall portion 6', 6" is substantially cylindrical. Hereby, the first wall section 6' is connected to the suction pipe 4 in one piece manner.

The cover part 2 comprises a multiplicity of openings 12 through which the oil returns to the oil pan in the bottom part 3 after it has lubricated the engine. Moreover, the cover part 2 is connected in one piece manner to a cover unit 8 which rests in sealing manner on the wall portion 6', 6" in the assembled state of the oil pan arrangement 1 so that it is only possible for the oil to flow through the suction windows 7', 7" into the suction pipe 4. In the present exemplary embodiment, the cover part 2 is fixed to the bottom part 3 by means of bolted connections 14. Self-evidently, non-positive/positive connections are possible as an alternative.

Figure 2:
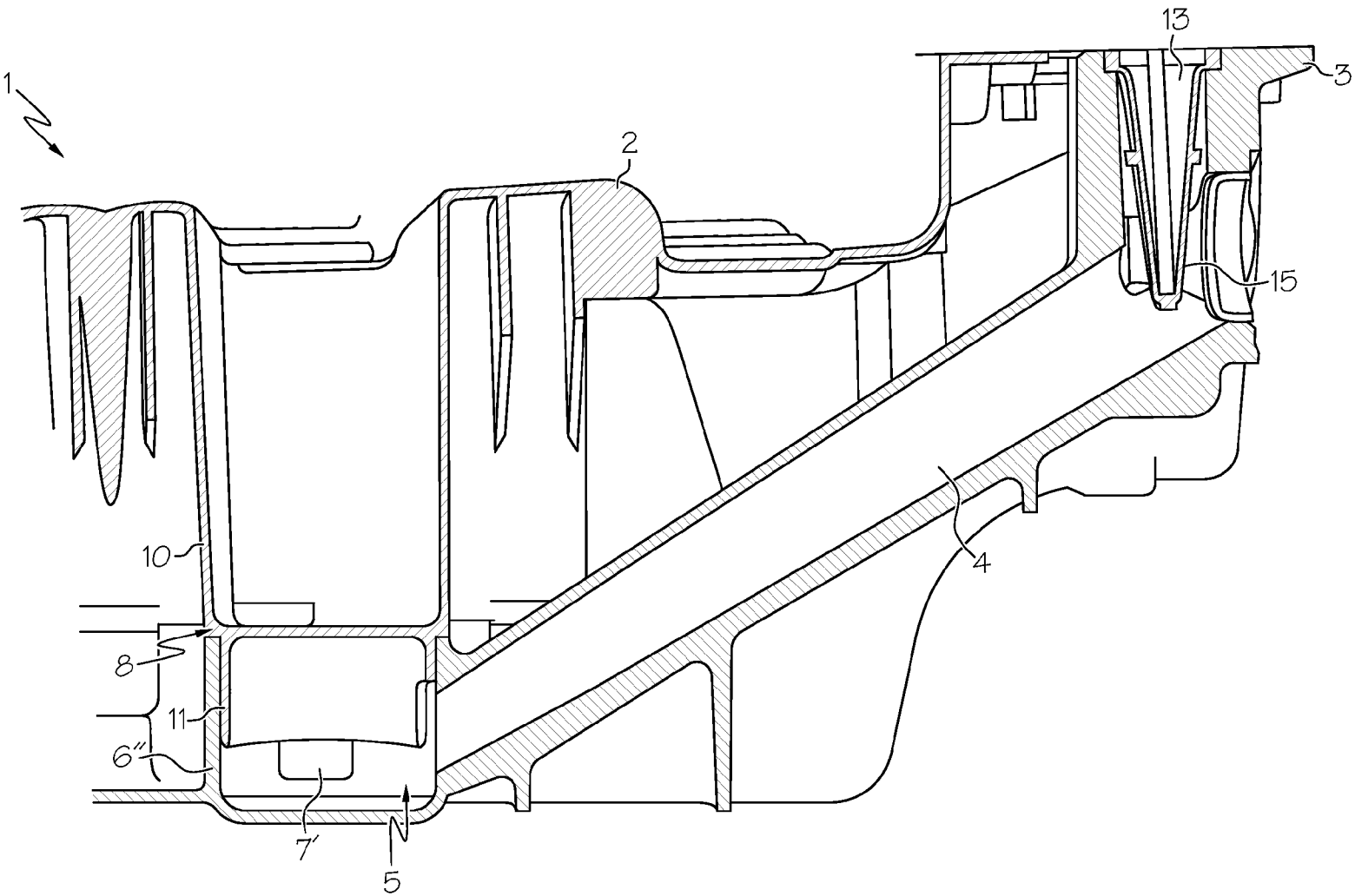
FIG. 2 shows a sectional view of the oil pan arrangement in the assembled state.

The suction pipe 4 is in the form of a cone in the present exemplary embodiment, which means that the diameter of the suction pipe 4 at the point where it merges into the suction region 5 is of a smaller diameter than at the opposite end to the suction region 5 at which a filter unit 13 is arranged (see FIG. 2). The conical design of the suction pipe 4 is determined by the manufacturing process. If the bottom part 2 is manufactured by a pressure die casting process, the geometrical shape of the suction pipe 4 is formed by a slider which is withdrawn from the formed suction pipe 4 at the end of the pressure die casting process. In order to seal the suction pipe 4 at the end opposite the suction region 5, there is used a sealing element 15 (plug) which can be connected to the bottom part 3 in positive and/or non-positive and/or cohesive manner. The filter 13 may, for example, be a coarse filter which consists of an e.g. synthetic material. This filter 13 initially sieves out larger particles from the flow of oil that is being effected. A further fine filtering process takes place in a not illustrated second filter, the filter elements of which may preferably consist of paper or fibrous material fillings.

Moreover, FIG. 2 shows the second wall section 6" as well as the suction window 7' at the suction region 5. Here, the suction region 5 is reliably closed from above by the cover unit 8. Hereby, the cover unit 8 comprises an upper 10 and a lower portion 11, wherein the upper portion 10 is of greater diameter than the lower portion 11. The lower portion 11 projects into the suction region 5 in the direction of the bottom part 3, whereas the upper portion 10 rests on the wall portion 6', 6". In the exemplary embodiment shown, the cover unit 8 is a light press fit on the wall portion 6', 6".

As FIG. 2 likewise makes clear, a part of the suction window 7' is covered by the cover unit 8. The bottom part 3 which is in the form of a pressure die cast part may, for example, consist of a material which comprises aluminium and/or magnesium. In another not illustrated embodiment, it is likewise possible to produce the bottom part 3 as an injection moulded part consisting of a synthetic material. The cover unit 8, which is connected in one piece manner to the cover part 2 in the present example, may consist of an injection moulded part consisting of a synthetic material or a metal.

Figure 3:
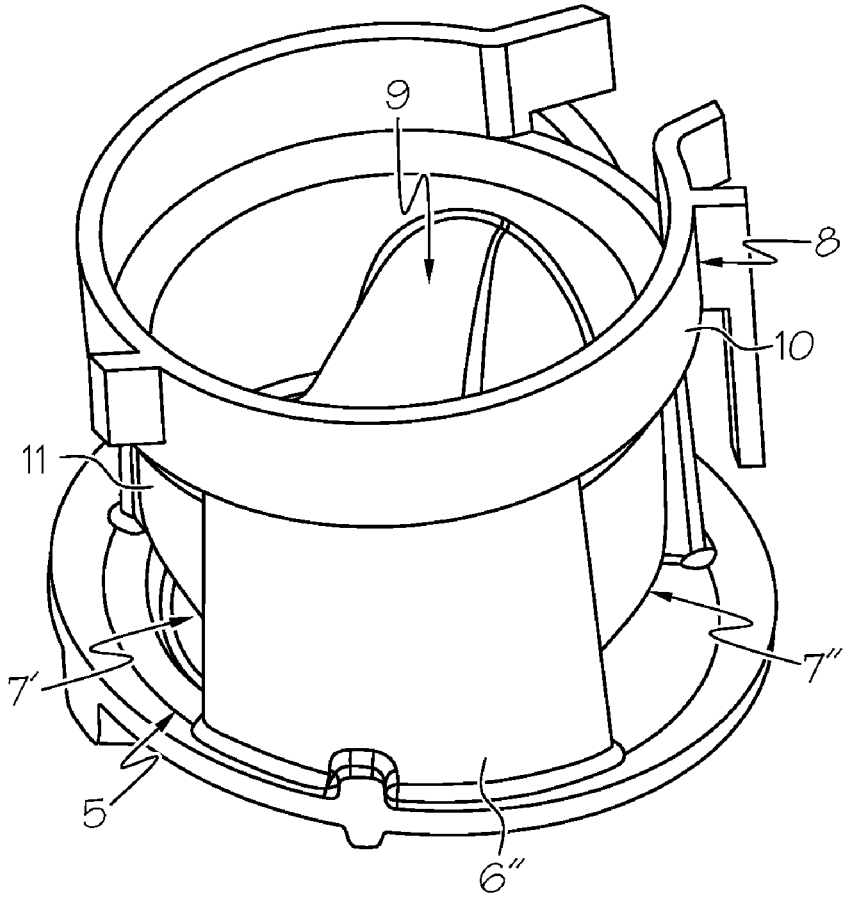
FIG. 3 shows an enlarged illustration of the suction region.

FIG. 3 shows the suction region 5 with the wall portions 6', 6" and the suction windows 7', 7". The suction windows 7', 7" are partially covered by the lower portion 10 of the cover unit 8 so that there is a resultant defined throughput of oil through the suction windows 7', 7" toward the suction pipe 4. In FIG. 3, the upper portion 10 of the cover unit 8 is illustrated in the form of a sectional view in order to expose the suction region 5 within the wall portions 6', 6".

Figure 4:
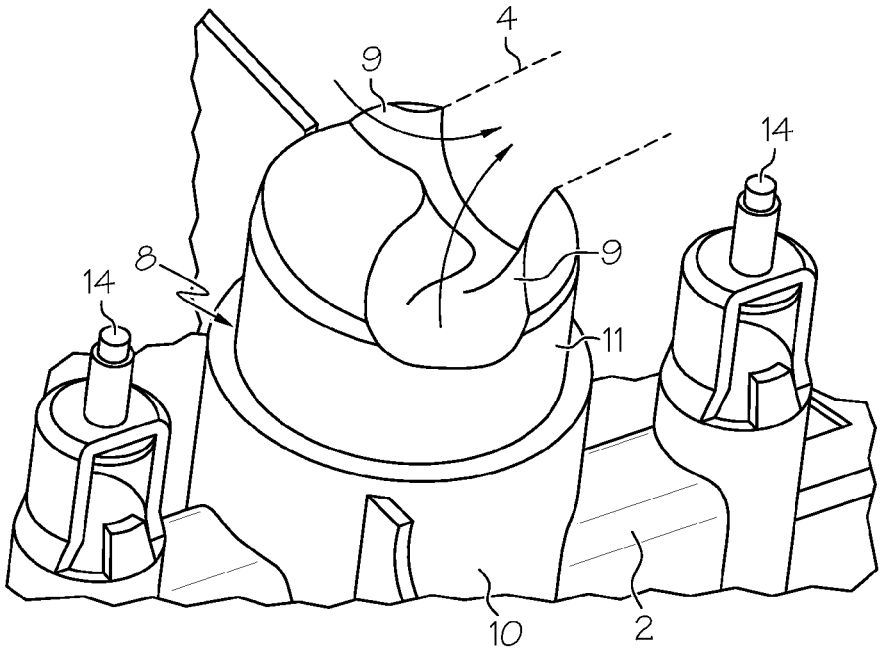
FIG. 4 shows a three-dimensional illustration of a cover unit incorporating guidance channels and FIG. 5 shows an enlarged illustration of the suction region with the cover unit and a wall portion of the suction region.
Figure 5:
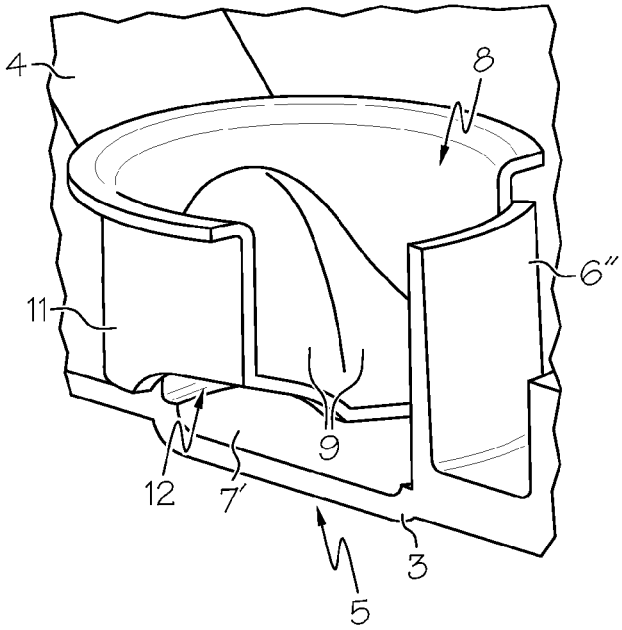

In order to obtain a satisfactory flow of the oil from the oil pan through the suction windows 7', 7" towards the suction pipe 4, the oil pan arrangement 1 comprises guidance means 9 in the form of flow channels which are arranged on the cover unit 8 (see FIGS. 3, 4, 5). The flow channels 9 extend from the respective suction window 7', 7" to the input portion of the suction pipe 4. The flow channels 9 provide for controlled guidance of the oil flow within the suction region 5 thereby enabling any occurring pressure losses to be kept low. In the illustrated exemplary embodiment, the opening 12 of the flow channels 9 facing the suction windows 7', 7" is at least partially oval-shaped.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. An oil pan arrangement for an internal-combustion engine, comprising:

a cover part;

a bottom part for the cover part;

a suction region of the bottom part comprising a wall portion having at least one suction window and a cover unit integrated into the cover part, wherein the cover unit contacts the wall portion and defines at least one side of the suction window; and at least one suction pipe which opens out into the suction region of the bottom part, wherein the suction pipe is connected in a one piece manner to the suction region and the bottom part.

2. An oil pan arrangement in accordance with claim 1, wherein the wall portion incorporates a first and a second wall section which are separated by a first and a second suction window.

3. An oil pan arrangement in accordance with claim 2, wherein the first wall section is connected to the suction pipe in one piece manner.

4. An oil pan arrangement in accordance with claim 1, wherein the cover unit is connected to the wall portion in a positive manner.

5. An oil pan arrangement in accordance with claim 4, wherein the cover unit comprises an upper and a lower region, wherein the upper region has a greater diameter than the lower region.

6. An oil pan arrangement in accordance with claim 5, wherein the cover unit at least partially closes a suction window.

7. An oil pan arrangement in accordance with claim 1, wherein the suction region comprises a guidance means for guiding the oil into the suction pipe.

8. An oil pan arrangement in accordance with claim 7, wherein the guidance means is arranged on the cover unit.

9. An oil pan arrangement in accordance with claim 1, wherein the bottom part is a pressure die cast part made of metal or an injection molded part of synthetic material.

10. An oil pan arrangement in accordance with claim 9, wherein the bottom part consists of a material which comprises aluminum and/or magnesium.

11. An oil pan arrangement in accordance with claim 1, wherein the wall portion is substantially cylindrical.

12. An oil pan arrangement in accordance with claim 1, wherein the cover unit is connected to the cover part in one piece manner.

13. An oil pan arrangement in accordance with claim 1, wherein the cover part is an injection molded part of synthetic material.

14. An oil pan arrangement in accordance with claim 1, wherein the cover part comprises openings through which the oil flows into the bottom part.

15. An oil pan arrangement in accordance with claim 1, wherein a filter is arranged at the opposite end of the suction pipe to the suction region.

* * * * *